United States Patent [19]

Bair

[11] Patent Number: 4,957,794

[45] Date of Patent: Sep. 18, 1990

[54] ARAMID FLUFF

[75] Inventor: Thomas I. Bair, Wilmington, Del.

[73] Assignee: E. I. DuPont de Nemours and Company, Wilmington, Del.

[21] Appl. No.: 460,256

[22] Filed: Jan. 2, 1990

[51] Int. Cl.[5] ..... B32B 5/12

[52] U.S. Cl. ..... 428/74; 428/68; 428/288; 428/296; 428/297; 428/298; 428/369; 428/395

[58] Field of Search ..... 428/68, 74, 288, 296, 428/297, 298, 369, 395

[56] References Cited

U.S. PATENT DOCUMENTS 3,922,756 12/1975 Ogasawara et al. ..... 19/148
4,618,531 10/1986 Marcus ..... 428/283
4,747,550 5/1988 Jackering ..... 241/55
4,783,364 11/1988 Ilan ..... 428/288
4,794,038 12/1988 Marcus ..... 428/288

FOREIGN PATENT DOCUMENTS 3700680 7/1988 Fed. Rep. of Germany .
63-50559 3/1988 Japan .

*Primary Examiner*—James J. Bell

[57] ABSTRACT

A composition is disclosed which comprises a fluff of aramid fibers wherein some of the aramid fibers are in the form of balls of the fluff. The composition is particularly useful for insulation, absorption, cushioning, and the like.

17 Claims, 5 Drawing Sheets

ARAMID FLUFF

BACKGROUND OF THE INVENTION

1. Field of the Invention

This invention relates to fluff and fluff balls of aramid fibers having extremely low density. The fluff and fluff ball product of this invention is useful by virtue of its very high absorbency, resiliency, heat and flame resistance, insulative properties, and the like.

2. Description of the Prior Art

U.S. Pat. No. 4,794,038, issued Dec. 27, 1988 discloses balls of polyester materials and the manufacture of such balls. That patent describes the necessity of using polyester fibers having a spiral crimp and making balls by repeatedly air-tumbling the fibers with a spiral crimp against the wall of a vessel.

SUMMARY OF THE INVENTION

The present invention provides an aramid fiber with an extended length of 0.4 to 3.0 cm and having at least two out-of-plane crimps along its length; and a mass of such fibers having such crimps and having a density of less than 0.08 g/cc at a load of 0.26 N/cm$^2$ (0.37 psi).

The fibers in the fluff of this invention are not appreciably fibrillated and have a specific surface area which is similar to the specific surface area of uncrimped staple fibers before fluff formation (about 0.1 to 0.4 m$^2$/g).

The present invention provides a fluff of aramid fibers wherein the density is less that 0.08 g/cc at a load of 0.26 N/cm$^2$ and wherein there are, included in the fluff, distinct balls of aramid fibers having a diameter of less than 10 mm and, usually, less than 5 mm. There are, generally, from 1 to 25 balls per milligram of fluff.

There are, also, provided structures including combinations of the aramid fluff with additives and binders of various kinds such as fibrids or thermoplastic fibers.

DETAILED DESCRIPTION OF THE INVENTION

Figure 1:
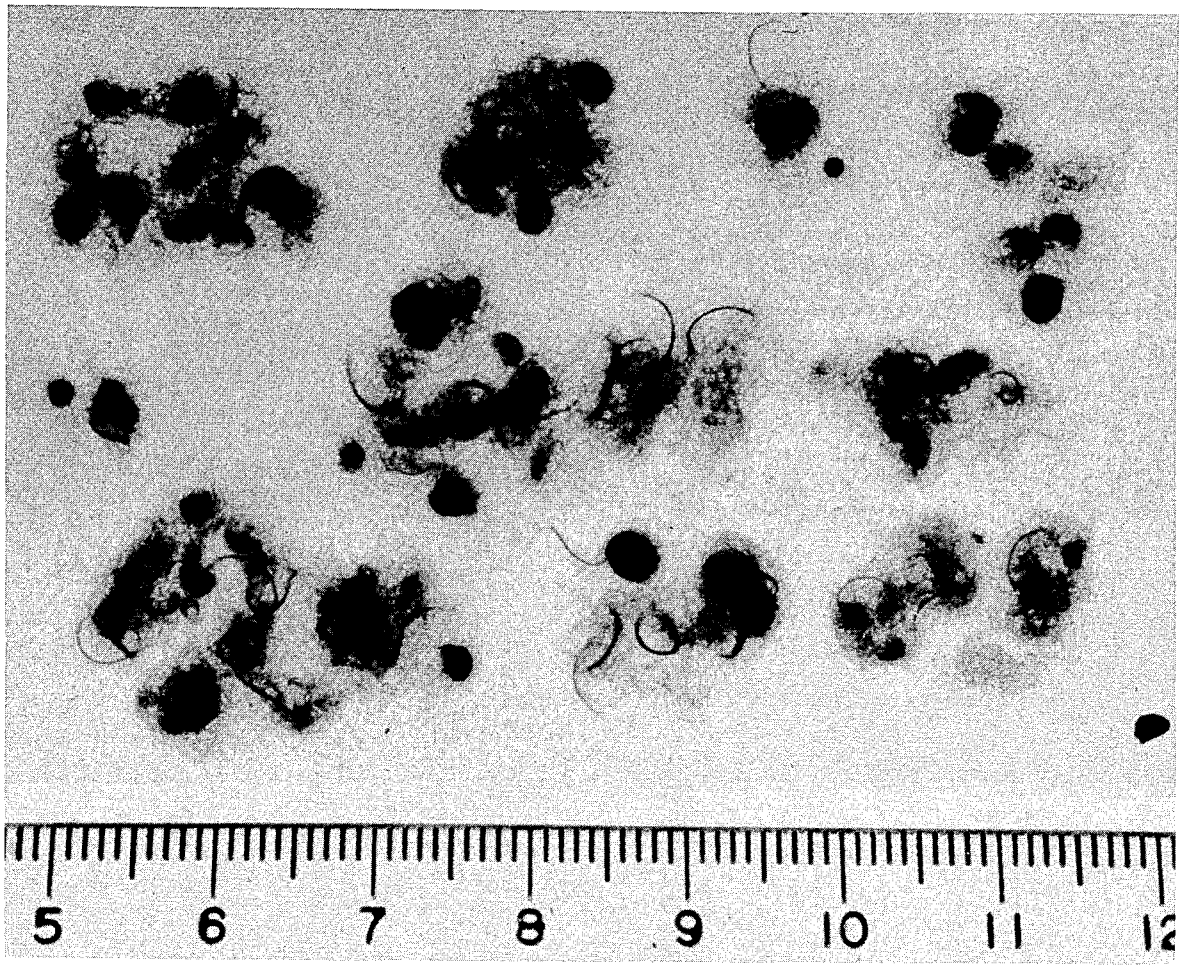
FIGS. 1–5 are photographs of the fluff of this invention with several degrees of ball formation. To provide a perspective on size, the Figs. each include a scale indicating centimeters.
Figure 2:
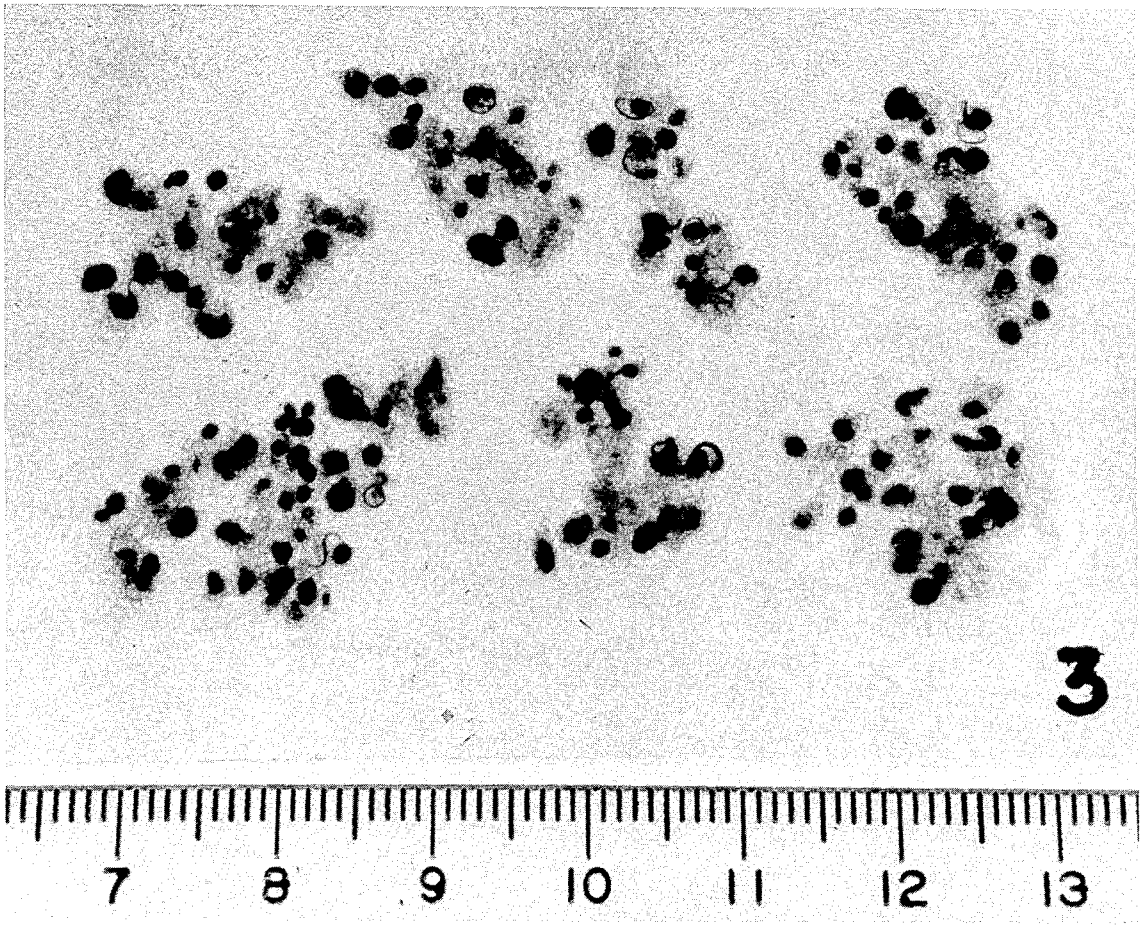
Figure 3:
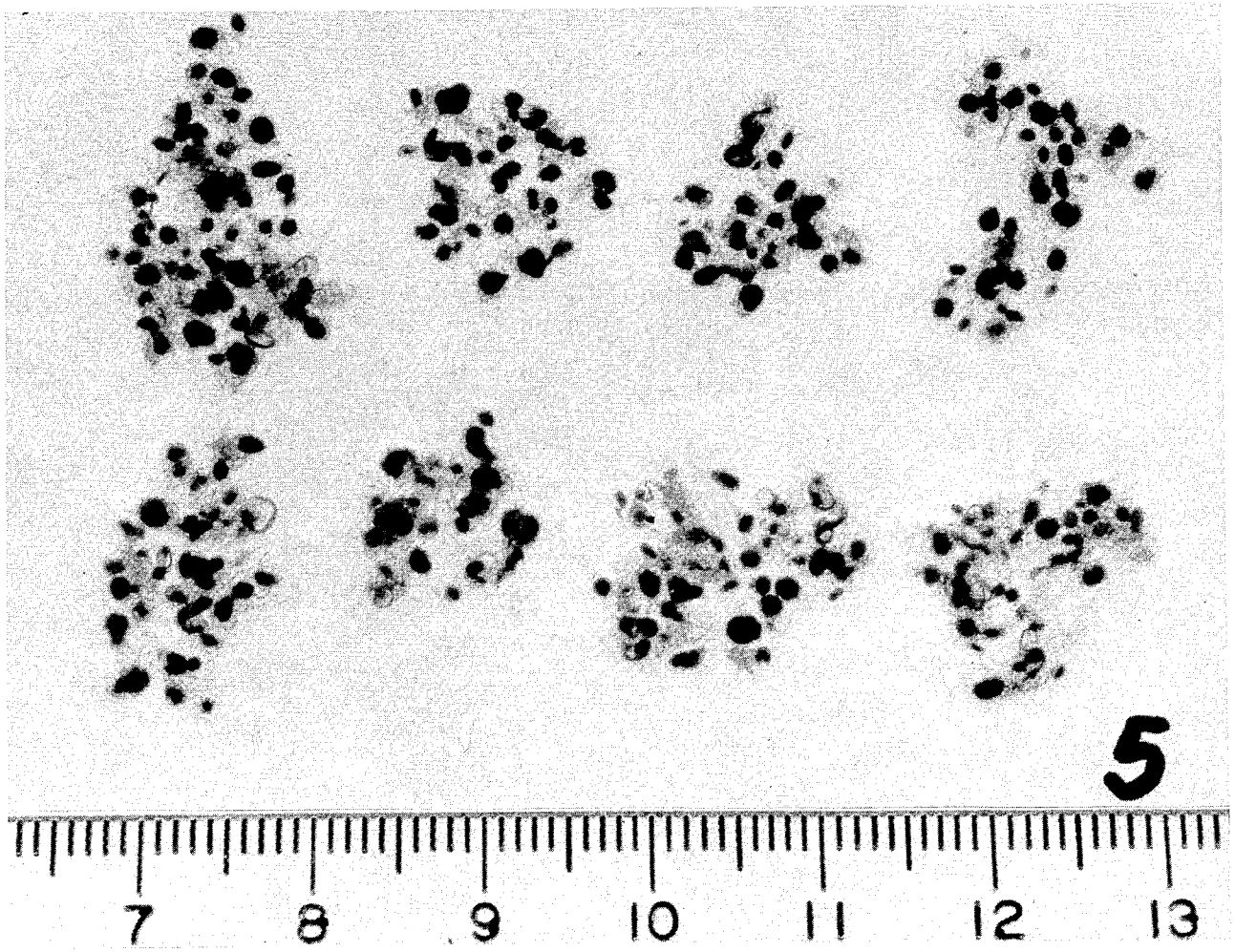
Figure 4:
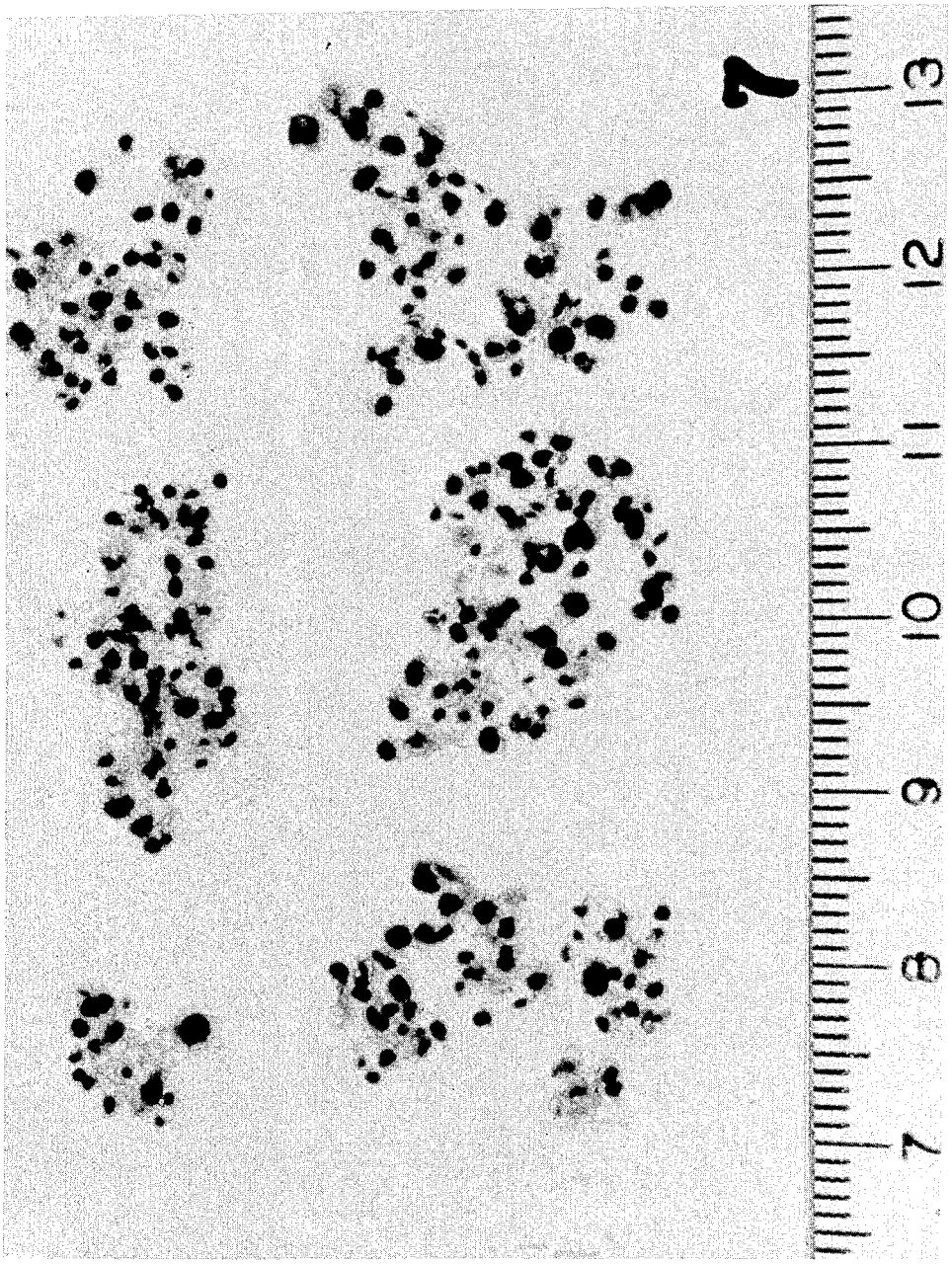
Figure 5:
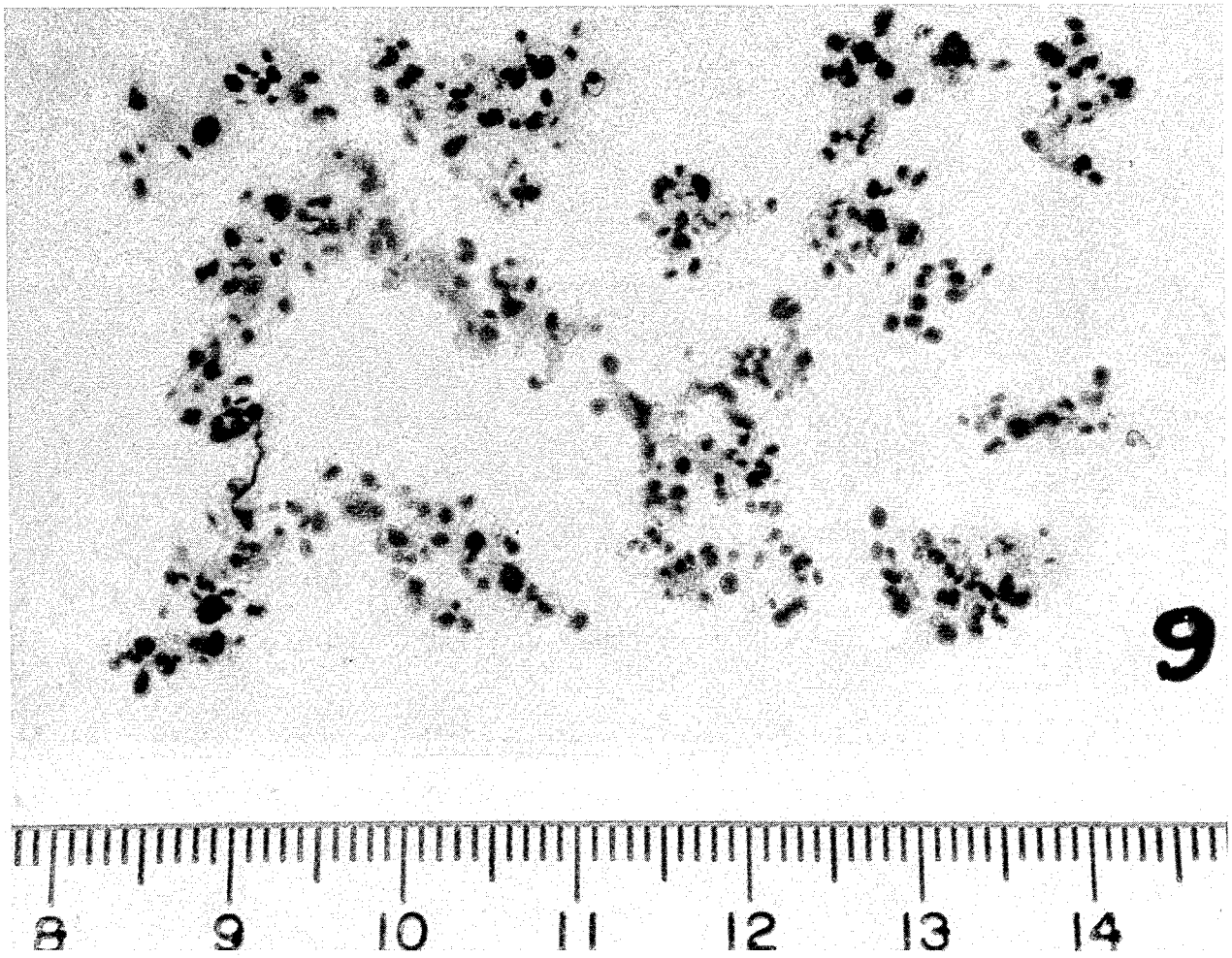

The fibers of this invention are made from aramids. A mass of such fibers is termed a fluff. By "aramid" is meant a polyamide wherein at least 85% of the amide $$(-\underset{\underset{O}{\|}}{C}-NH-)$$

linkages are attached directly to two aromatic rings. Suitable aramid fibers are described in Man-Made Fibers - Science and Technology, Volume 2, Section titled Fiber-Forming Aromatic Polyamides, page 297, W. Black et al , Interscience Publishers, 1968. Aramid fibers are, also, disclosed in U.S. Pat. Nos. 4,172,938; 3,869,429; 3,819,587; 3,673,143; 3,354,127; and 3,094,511.

Additives can be used with the aramid and, in fact, it has been found that up to as much as 10 percent, by weight, of other polymeric material can be blended with the aramid or that copolymers can be used having as much as 10 percent of other diamine substituted for the diamine of the aramid or as much as 10 percent of other diacid chloride substituted for the diacid chloride of the aramid.

The fibers of this invention are from about 0.4 to about 3 centimeters long. It has been found that fibers with a length of less than 0.4 centimeters cannot be properly crimped and, therefore, do not exhibit proper fluffing qualities. As to the upper extreme, it has been found that fibers longer than about 3 centimeters become entangled into ropelike structures and cannot be adequately processed. The preferred fiber lengths for this invention are from about 0.5 to about 2.0 centimeters because within that range the individual fiber crimping appears to be easily and efficiently performed and the fluff product exhibits a uniformly and surprisingly low density.

The diameter of fibers is usually characterized as a linear density termed denier or dtex. The denier of fibers eligible for use in this invention is from about 0.5 to 5, or, perhaps, slightly higher. For any given set of conditions, fibers of higher denier yield fluff with fewer and larger fluff balls. At very high denier, such as about 10, the fluff becomes undesirably stiff and wire-like and loses its absorptive capacity and resilience. However, the fluff of high denier fibers can find use in insulation batting and filter media, and the like.

The fluff of this invention is, generally, made from fibers which have been spun using a so-called air gap spinning process. It is possible that fibers made by other means could be used so long as they are tough enough not to break or fibrillate under the forces of crimping and they are sufficiently oriented and crystallized not to be materially elongated in the crimping mill. For example, aramids could be wet spun as taught in U.S. Pat. No. 3,819,587. Such fibers are advantageously spun with high orientation and crystallization and can be used as-spun. Fibers wet spun from isotropic dopes and drawn to develop orientation and crystallinity, as taught in U.S. Pat. No. 3,673,143, are also useful. The air gap (dry-jet) spinning is as taught in U.S. Pat. No. 3,767,756. Dry spinning with subsequent drawing to develop orientation and crystallinity, as taught in U.S. Pat. No. 3,094,511, is another useful method for making the feed fibers of this invention.

The aramid fibers are spun as a continuous yarn and the yarn is cut to the desired length for further processing in accordance with this invention. The cut fibers, known as staple, exhibit a specific surface area of about 0.2 m$^2$/g and a density, in a mass, of about 0.2 to 0.3 g/cc. The staple is then subjected to the action of a turbulent air grinding mill having a multitude of radially disposed grinding stations including thick blades with essentially flat surfaces spaced further apart than the thickness of the fibers and surrounded by a jacket stator with raised ridges;—the gap between the ridges and the flat surfaces of the blades being about 0.5 to 4 mils. The effect of the sharpness of the jacket ridges and the blade edges has not been studied, but it is believed that a fluff with a greater number and smaller size fluff balls is obtained when those ridges and edges are more sharp.

A Model III Ultra-Rotor mill, as sold by Jackering GmbH & Co. KG, of West Germany, is suitable for use in the practice of this invention. This mill contains a plurality of milling sections (that is, blades) mounted on a rotor in a surrounding single cylindrical stator with rilled walls common to all milling sections. The mill has a gravity feed port leading to the bottom section of the rotor. Additionally, three air vents are equally distributed around the bottom of the cylinder surface. An outlet is located on the top of the surrounding stator. A detailed description of a similar mill is in U.S. Pat. No. 4,747,550 issued May 31, 1988.

It is believed that the fibers are struck by blades of the grinding machine and are crimped at the points of contact. When an individual fiber has been struck several times and has been crimped accordingly, it is believed that, at that time, the fiber commences to form into a small ball. An important element of this invention and an element which, it is believed, makes the fibers of this invention patentable, is the fact that the fibers are crimped at random angles around the fiber axis and, thereby, are caused to become three-dimensional bodies which entangle readily with adjacent crimped fibers. It is, also, important that the fibers, while crimped, are not significantly fibrillated. The specific surface area of the crimped fibers of this invention is substantially the same as the specific surface area of the staple fiber starting material. For purposes of comparison, it is noted that the specific surface area of aramid staple and of the fluff product of this invention is about 0.2 $m^2/g$; and the specific surface area of microfibrillar pulp made by refining that aramid staple, is generally greater than 5 and often as much as 10 $m^2/g$.

The density of the staple starting material in practice of this invention decreases as the staple is opened and crimped. The density then increases as the number of fluff balls increases and the size of the fluff balls decreases. It is believed that crimping causes a decrease in the density and that formation of fluff balls causes an increase in the density. Continued grinding after the fibers have been crimped causes increased formation of fluff balls and increased density. Look to the several Figs. to observe the increased formation of fluff balls with increased milling. FIG. 1 represents only a single pass through the mill, while FIGS. 2, 3, 4, and 5 represent 3, 5, 7, and 9 passes, respectively, through the mill. After each pass, the fluff balls appear to include more of the fluff and to be slightly more compact.

It has been ascertained that any fluff having a density of less than 0.08 g/cc is useful, whether it contains fluff balls or not. It has, also, been ascertained that fluff having a density of less than 0.06 g/cc is especially useful for insulation and absorption applications. Fluff containing a large number of fluff balls and a density of greater than 0.06 g/cc is especially useful in cushion applications where resilience and re-fluffing are important. The larger the percentage of fiber material entangled into fluff balls, the more refluffable the mass becomes. The fluff of this invention can be identified as an aramid fiber product which has a density of less than 0.08 g/cc and contains at least one fluff ball per milligram of fluff. The presence of fluff balls aids in pneumatic conveying of the mass and assures a majority of the fibers have an out-of-plane crimp.

While it is difficult to determine, with accuracy, the amount of energy used to create the fluff balls of this invention, it has been found that more fluff balls exist in a mass of material each time it is passed through the mill. The more passes through the mill, the more fluff balls and the smaller the fluff balls.

The fluff of this invention is useful in a wide range of products including, as a few examples, filter media, high temperature insulation, resilient filling, absorbency applications, fire blocking, and reinforcement. The highly balled fluff is preferred for the resiliency applications, such as fire resistant cushioning uses and the fluff at near the minimum density is preferred for the insulation and absorption uses.

The fluff can be combined with other materials, either before or after the fluffing process, to obtain the benefits of the other materials in combination with the benefits of the fluff of this invention. For example, the fluff of this invention can be combined with fibrid binder material. U.S. Pat. No. 2,999,788 contains a description of suitable fibrid materials. Suitable fibrid binder materials are generally aramids and, specifically, can be poly(m-phenylene isophthalamide) and poly(p-phenylene terephthalamide), and copolymers including the components of those polymers, and the like. Self-coherent sheet structures with useful filtration, fire-blocking, wicking, and insulative properties are made by wet-laying a well mixed slurry of fibrids and the fluff of this invention. The percent fibrids is important with respect to the density, flexibility and strength of the sheet obtained. Sheets with less than about 1 percent fibrids have insufficient cohesiveness, as-made, to be practically handled. Preferably, at least about 3 percent fibrid material is used in order to obtain readily handleable sheets. Sheets containing more than about 50% fibrids are boardy and have low air permeability making them inferior for insulation and filtration uses. Preferably, the fibrid level is less than about 30% in order to yield sheets of superior insulation, permeability and absorption. Small, single, wet-layed sheets can be made by depositing the fibrid/fluff mixture on a screen. Continuous roll goods are made using a Fourdrinier paper making machine or, preferably, using a rotoformer machine. Especially preferred structures for insulation and flame blocking are made on a rotoforming machine and dried on a thru-drier such as sold by Honeycomb Systems, Inc., Biddeford, Me., USA. Thru-drying or ambient drying is preferred to hot rolls so as to maintain high porosity, high permeability, and low density.

As another example, the aramid fluff can be mixed with a thermoplastic staple or short-fiber pulp and wet laid or dry laid and then thermally bonded to make a light weight, permeable mat of low density. In such a combination of material, the aramid fiber fluff should constitute at least 20 weight percent and the thermoplastic fibers should be no more than 80 weight percent of the product. It is preferred that the aramid fiber fluff should be 20 to 80 weight percent of the product. Such a mat is useful for filtration, insulation, and fire-blocking applications. Optionally, the non-bonded mat can be draped around geometrically curved shapes, such as hemispheres or cylinders, to form shaped structures useful, for example, as hot gas filters. Also, thermoplastic staple can be run through the mill to form a thermoplastic fluff prior to mixing with the aramid fluff of this invention and formed into mats as above. Such mats have very high air permeability after thermal bonding and are especially useful as filtration fabrics where high air-flow is desired. Optionally, the aramid feed staple and thermoplastic feed staple can be combined and jointly run through the mill to provide well mixed fluff mixtures which can be formed into useful mats by wet or dry laying methods.

The fluff of this invention is evaluated by means of density, absorbency, compression under load, specific fluff ball count and size, and flame and thermal tests. Test methods for such evaluations are set out below.

Density. Density of the fluff is determined as a function of a pressure which is applied to the fiber fluff under test. To determine density, a known weight of fiber fluff is placed under a known pressure and the volume of the fluff is determined.

For the densities reported herein, an outer cylinder having an internal diameter of 6.9 centimeters and about 10 inches long, was stood on its end as a fluff reservoir; and an inner cylinder having an outside diameter of about 2½ inches and a plate of 2 11/16 inches diameter welded onto the bottom end was used as a plunger inside the outer cylinder. The plate had an area of 5.7 $in^2$.

To conduct the test, about 11.0 grams of fluff are placed into the outer cylinder and the inner cylinder is put in place over the fluff. The outer cylinder is tapped vigorously until the inner column does not settle any more. The height of the fluff in the column is measured and the density is calculated. Weights can be placed in the inner cylinder to determine the density as a function of differing pressures. A pressure of 0.37 psi has been taken as a standard pressure for the purposes of describing this invention. Such a pressure requires that the total weight of the inner cylinder must be 2.12 pounds (965 grams).

$$\text{Density (g/cc)} = \frac{\text{grams of fiber}}{(37.4\ \text{cm}^2)(\text{height of fiber, cm})}$$

Basis Weight. Basis weight of a fibrous article is obtained under ambient conditions by cutting from the sample a rectangular or square section having edges no smaller than 3 inches and no larger than 10 inches. The section is weighed and the basis weight, in ounces/-square yard, is calculated. Density of a fibrous article is determined using the basis weight and the sample thickness.

Surface Area. Surface area of the fluff was determined from nitrogen adsorption by the method of Baunner, Emmet, and Teller (BET) using a Model 2100 Surface Area Pore Volume Analyzer sold by Micromeritics Instruments Corp., Norcross, Ga., USA. The fluff was conditioned for the test by exposing it to a vacuum of less than 0.1 torr for about 16 hours at about 80° C.

Air Permeability. Air permeability of a fibrous article is determined under ambient conditions using a Fabric Permeability Machine sold by Frazier Precision Instrument Co., Gaithersburg, Md., USA. In conducting the test, air flow measurements are taken using a pressure differential of about 0.5 inches of water at 5 different regions of a sample, and the measurements are averaged.

Filtration Efficiency. Filtration efficiency is determined by producing an aerosol and determining the efficiency with which the aerosol can be filtered by the filter media under test.

For purposes of this test, the aerosol is made of polyethylene glycol (400 MW) with a median particle size of about 1 micron at a concentration of about 0.8 grams per standard cubic foot. A Laskin Nozzle is used to generate the aerosol. Laskin Nozzles are described in "Studies of Portable Air-Operated Aerosol Generators", Echols and Young, NRL Report 5929 (July, 1963); and use of Laskin Nozzles is described in American Industrial Hygiene Association Journal, Hinds, Macher, and First, Vol. 44, July, 1983, pp495–500. To perform the test, the aerosol is conducted through a conduit at a rate of 1.4 standard cubic feet per minute and through a filter of 3.14 square inches placed in the path of the aerosol. Samples are taken before and after the filter over a 30 minute time period. The efficiency is calculated as follows:

$$\text{Efficiency (\%)} = \frac{(\text{Inlet conc.} - \text{Outlet conc.})}{(\text{Inlet conc.})} \times 100$$

Fluff Ball Count and Size. To make a fluff ball count and determine the ball size, the number of fluff balls in a small sample are actually counted and measured..

A small, weighed, portion of fluff is thinly spread onto a small (75 mm×50 mm) microscope slide and gently covered with a second slide. A photograph is made of the fluff at any convenient enlargement and the fluff balls are counted and sized. A correctly exposed photograph will cause the fluff balls to show in dark contrast to the non-balled fibers. The Figs. are examples of this procedure.

Thermal Protective Performance (TPP). Thermal protective performance is a measure of the heat transfer through a fabric under particular conditions in order to determine the degree of protection provided by the fabric against burns. The test is conducted in accordance with ASTM D 4108 as described in Chapter 5 of the NFPA 1971 Standard on Protective Clothing for Structural Fire Fighting (1986 Edition).

Thermal Resistance. The thermal resistance test is a measure of thermal transmission through flat specimens; and is conducted in accordance with ASTM C 518–85. The testing apparatus used for tests reported in this specification was a Dynatech Rapid-k apparatus sold by Holometrics, Inc. Cambridge, Mass., USA.

DESCRIPTION OF THE PREFERRED EMBODIMENTS

EXAMPLE 1.

In this example, a commercially available aramid fiber was processed into the fluff and fluff balls of this invention. Poly(p-phenylene terephthalamide) staple having a length of 0.625 centimeter and a denier of 1.5 was fed through a multi-station rotor mill operated at 1200 rpm with a clearance of 0.5 to 1 millimeters. The aramid fiber product was identified as Kevlarx® T-790 sold by E. I. du Pont de Nemours & Co., Wilmington, Del.; and was pre-crimped at a rate of four crimps per inch. The mill was a Model III Ultra-Rotor, sold by Jackering GmbH & Co., KG, West Germany.

In processing the fibers, all vents on the mill were closed and the fibers were cycled, successively, through the mill. After selected cycles, the density, fluff ball count, and the average fluff ball size were determined. The results of those determinations are shown in FIGS. 1–5 and are set out in Table I.

TABLE I

| Cycle | Density* (g/cc) | Ball Count (balls/mg) | Ball Size (mm) | FIG. |
|---|---|---|---|---|
| 1 | 0.045 | 1.4 | 3.1 | 1 |
| 3 | 0.052 | 6.3 | 1.5 | 2 |
| 5 | 0.064 | 9.6 | 1.2 | 3 |
| 7 | 0.070 | 13.2 | 1.0 | 4 |
| 9 | 0.074 | 13.8 | 0.9 | 5 |

*Density determined at 0.37 pounds per square inch (0.26 $N/cm^2$)

EXAMPLE 2.

In this example, aramid fiber of the same length and denier as was used in Example 1, but without pre-crimping, was fed through the same multi-station rotor mill as was used in Example 1, with the same settings. After only one cycle, the fluff had a density of 0.047 g/cc and there were 8.2 fluff balls per milligram of fluff. The surface area of the fluff was 1.6 $m^2$/gram as compared with 0.2 $m^2$/gram for unfluffed staple. It can be noted that the surface area of pulp made from similar fiber material is about 8.5 $m^2$/gram.

For an absorbency test, 18.0 gram portions of the fluff from this example were stuffed into socks of porous nonwoven fabric about 3 inches in diameter and 6 inches long. In some socks, the fluff was used without any additive; and, in some socks, the fluff was treated with a dilute solution of an amphoteric rewetting agent known as "Miranol CP 2N", sold by Miranol, Inc. of Dayton, N.J., and then dried. Those socks were used to determine absorbency of several liquids: Socks with no additive on the fluff absorbed 261 grams of oil and 111 grams of water. Socks with treated fluff absorbed 240 grams of 20% sodium hydroxide solution, 264 grams of 40% sulfuric acid, 216 grams of water, and about the same amount of oil as was absorbed using untreated fluff.

As a comparison, socks stuffed with a commercially available polyolefin absorbent fiber, such as "Tywik", sold by E. I. du Pont de Nemours & Co., were found to absorb up to ten times their weight of water while the socks stuffed with the fluff of this invention absorbed at least twelve times their weight.

It is noted that absorbed liquid can be squeezed from the socks of this invention and the socks can be used repeatedly while socks filled with other absorbent materials do not recover sufficient absorbency, after removal of absorbed liquid, to be repeatedly useful. Socks filled with the fluff of this invention recover absorbency because the fluff of this invention is so resilient that it springs back to its original fluffed quality after being squeezed to remove absorbed liquid.

EXAMPLE 3.

In this example, the same staple from Example 2 was used with the same mill from Example 1 except that two of the vents were opened slightly. The fluff obtained exhibited a density of 0.045 g/cc and a fluff ball count of 6.1 balls/milligrams after one cycle.

Ninety-four (94) parts of the fluff were blended with six (6) parts of poly(meta-phenylene isophthalamide) fibrids; and that blend was wet-layed at 20 ft/min as a 0.1% aqueous furnish, while adding water at the head box sufficient to dilute the blend to 0.015% solids. The wet mat was continuously dried in a through-air oven at 550° F. The product exhibited a density of about 3.3 pounds per Cubic foot. The poly(meta-phenylene isophthalamide) fibrids are described in U.S. Pat. No. 2,999,788. In the dried fluff product of this Example, the fluff was held in a predetermined mat shape by the fibrids.

The mat had a basis weight of about 4.7 to 5 OPSY (OPSY=ounces per square yard) and a thickness of about 125 to 130 mils. It exhibited a tensile strength of 24.5 pounds per square inch in the machine direction.

The mat exhibited an air permeability of 102 cfm/square foot and a surface area of 2.3 square meters per gram. The filtration efficiency was found to be about 70% for a polyethylene glycol (PEG) aerosol of about 1 micron median particle size.

The mat exhibited a thermal protective performance value of 24.0 cal/$cm^2$ (4.9 cal/$cm^2$/OPSY). For comparison purposes, it can be noted that a similar blend of materials made into a spunlaced fabric with a 3.8 OPSY has been reported, in Research Disclosure number 2215, October, 1982, to exhibit a thermal protective performance value of 12.3 cal/$cm^2$ (3.2 cal/$cm^2$/OPSY).

EXAMPLE 4.

In this example, fluff of the same material as was used in Example 2 was prepared by the same method as in Example 2 except that the three vents were open slightly. One cycle was used and the fluff had a density of 0.039 g/cc and a fluff ball count of 5.1 balls/milligram.

Ten grams of the fluff was blended with ten grams of a 0.25 inch long binder fiber of poly(vinylchloride-co-vinylacetate), and the blend was dispersed into 2 liters of water to make a sheet furnish. The furnish was poured onto a sheet-forming screen to make a pad 12 inches×12 inches. The pad was dried and bonded at 150°-160° C. with no pressure; and was then trimmed to make a filter pad 10.5 inches×10.5 inches. The pad of this Example was held together by the thermobonded thermoplastic fibers. The pad had a basis weight of 5.6 OPSY, a thickness of 176 mils, a density of 2.7 pounds per cubic foot, and an air permeability of 244 cfm/square foot. The filtration efficiency was about 85% for a PEG aerosol of about 1 micron median particle size.

EXAMPLE 5.

In this example, a commercially available aramid fiber was processed into the fluff and fluff balls of this invention. Poly(meta-phenylene isophthalamide) staple having a length of 0.25 inch (0.625 centimeter) and a denier of 2.0 was fed through a multi-station rotor mill operated at 1200 rpm with a clearance of 0.5 to 1 millimeters. The aramid fiber product was identified as an aramid fiber bearing the trademark, "Nomex", Type E-20, sold by E. I. du Pont de Nemours & Co., Wilmington, Del. The mill was the same as that used in Example 1, above.

In processing the fibers, all vents on the mill were opened, slightly, and the fibers were cycled, successively, through the mill. After the selected number of cycles, the density, fluff ball count, and the average fluff ball size were determined. The results of those determinations are set out in Table II.

TABLE II

| Cycle | Density* (g/cc) | Ball Count (balls/mg) |
|---|---|---|
| 1 | 0.069 | 0.14 |
| 3 | 0.045 | 3.05 |
| 5 | 0.045 | 7.18 |
| 9 | 0.046 | 9.13 |

*Density determined at 0.37 pounds per square inch (0.26 N/$cm^2$)

EXAMPLE 6.

In this example, the same staple from Example 5 was used with the same mill from Example 1. The fluff obtained after one cycle exhibited a density of 0.037 g/cc and numerous fluff balls were present.

Forty-five (45) grams of the fluff were blended with five (5) grams of poly(meta-phenylene isophthalamide) fibrids; and that blend was wet-layed, as a 5% furnish, on the sheet forming device of Example 4. The wet sheet was dried in a vacuum oven at 150° C. The product exhibited a density of about 1.8 pounds per cubic foot. The pad had a basis weight of about 16.4 OPSY and a thickness of about 0.75 inch.

The pad exhibited a thermal resistance of 4.1 hr-ft$^2$-F.°/BTU-in. For comparison purposes, it can be noted that a commercially-available needled felt of poly(meta-phenylene isophthalamide) staple exhibits a thermal resistance of 4.1 hr-ft$^2$-F.°/BTU-in but at a density of 2.9 pounds/cubic foot.

EXAMPLE 7.

In this example, two different fluffs were combined to make a burn resistant pad. Sixty grams of the fluff of Example 6 were combined with 7.5 grams of the fluff of Example 4 and 7.5 grams of the fibrids of Example 5. The fluff and fibrid combination was vigorously mixed with about 1.8 liters of water and that was wet-layed on the sheet forming device of Example 4. The wet sheet was dried in a vacuum oven at 160° C. The product exhibited a density of 2.31 pounds per square foot. The pad had a basis weight of 26.5 OPSY and a thickness of 0.96 inch.

The mat exhibited a thermal protective performance value of 145 cal/cm$^2$ (5.43 cal/cm$^2$/OPSY). For comparison purposes, this mat was sandwiched as an interlayer between layers of a poly(meta-phenylene isophthalamide) shell to simulate the interliner of a fireman's turnout coat. Thermal protection performance for the sandwich was 3.0 cal/cm$^2$/OPSY, as compared with a value of 2.6 cal/cm$^2$/OPSY for a commercial interliner of poly(meta-phenylene isophthalamide).

I claim:

1. Aramid fiber fluff comprising aramid fibers with an extended length of 0.4 to 3 centimeters and having at least two out-of-plane crimps along their length, the fluff exhibiting a density of less than 0.08 g/cc at a load of 0.26 N/cm$^2$.

2. The fluff of claim 1 wherein the density is less than 0.06 g/cc.

3. The fluff of claim 1 wherein the fibers of the fluff have a specific surface area of less than about 5.0 m$^2$/g.

4. The fluff of claim 3 wherein the specific surface area is from 0.03 to 3 m$^2$/g.

5. Aramid fiber fluff comprising aramid fibers with an extended length of 0.4 to 3 centimeters and having at least two out-of-plane crimps along their length, the fluff exhibiting a density of less than 0.08 g/cc at a load of 0.26 N/cm$^2$ and wherein there are more than 1 and less than 25 fluff balls per milligram of aramid fiber having a diameter of less than 10 millimeters.

6. The fluff of claim 5 wherein the balls of aramid fibers have a diameter of less than 5 millimeters.

7. The aramid fiber fluff of claim 5 wherein the aramid fibers are selected from the group consisting of poly(p-phenylene terephthalamide), poly(m-phenylene isophthalamide), and mixtures of poly(p-phenylene terephthalamide) and poly(m-phenylene isophthalamide).

8. The aramid fiber fluff of claim 5 wherein the fluff is uniformly combined with thermoplastic fibers such that the combination is at least 20 weight percent aramid fluff and no more than 80 weight percent thermoplastic fibers.

9. The fluff of claim 8 wherein the thermoplastic fibers have been thermobonded.

10. The aramid fiber fluff of claim 8 wherein the thermoplastic fibers are poly(vinylchloride-co-vinylacetate).

11. The aramid fiber fluff combination of claim 8 wherein the fluff is 20 to 80 weight percent of the combination.

12. The aramid fiber fluff of claim 5 wherein the fluff is uniformly combined with aramid fibrids such that the combination is at least 70 weight percent aramid fluff and no more than 30 weight percent aramid fibrids.

13. The fluff of claim 12 wherein the fibrids hold the fluff in a mat shape.

14. The aramid fiber fluff of claim 12 wherein the aramid fibrids are poly(m-phenylene isophthalamide).

15. The aramid fiber fluff combination of claim 12 wherein the fluff is 70–97 weight percent of the combination.

16. A reusable liquid-absorbent sock comprising a porous fabric cover and a filler of aramid fluff comprising aramid fibers with an extended length of 0.4 to 3 centimeters and having at least two out-of-plane crimps along their length, the fluff exhibiting a density of less than 0.08 g/cc at a load of 0.26 N/cm$^2$.

17. The sock of claim 16 wherein the fluff has more than 1 and less than 25 fluff balls per milligram of aramid fiber and the balls have a diameter of less than 10 millimeters.

* * * * *